US005482397A

United States Patent [19]

Soleau

[11] Patent Number: 5,482,397

[45] Date of Patent: Jan. 9, 1996

[54] TIRE DEFLATOR AND METHOD OF DEFLATING A TIRE

[75] Inventor: Bert Soleau, Chantilly, Va.

[73] Assignee: Eagle Research Group, Inc., Arlington, Va.

[21] Appl. No.: 198,279

[22] Filed: Feb. 18, 1994

[51] Int. Cl.[6] ..... E01F 13/00

[52] U.S. Cl. ..... 404/6

[58] Field of Search ..... 404/6, 9–12; 256/14, 256/15, 17, 18

[56] References Cited

U.S. PATENT DOCUMENTS

| | | |
|---|---|---|
| 3,001,332 | 9/1961 | Wilder . |
| 3,387,824 | 6/1968 | Jonas et al. . |
| 3,456,920 | 7/1969 | Elvington . |
| 3,652,059 | 3/1972 | Groblebe . |
| 3,707,098 | 12/1972 | Kern . |
| 3,968,596 | 7/1976 | Danin . |
| 4,016,679 | 4/1977 | Ellefson . |
| 4,097,170 | 6/1978 | Dickinson . |
| 4,101,235 | 7/1978 | Nelson . |
| 4,133,140 | 1/1979 | Berard et al. . |
| 4,152,871 | 5/1979 | Kardash, Jr. . |
| 4,158,514 | 6/1979 | Dickinson . |
| 4,318,079 | 3/1982 | Dickinson . |
| 4,325,651 | 4/1982 | Szegi . |
| 4,354,771 | 10/1982 | Dickinson . |
| 4,367,975 | 1/1983 | Tyers . |
| 4,382,714 | 5/1983 | Hutchinson . |
| 4,473,948 | 10/1984 | Chadwick . |
| 4,490,068 | 12/1984 | Dickinson . |
| 4,544,303 | 10/1985 | Glasmire . |
| 4,554,695 | 11/1985 | Rowland . |
| 4,574,523 | 3/1986 | Nasatka . |
| 4,576,507 | 3/1986 | Terio . |
| 4,576,508 | 3/1986 | Dickinson . |
| 4,576,509 | 3/1986 | Beaty, Sr. . |
| 4,577,991 | 3/1986 | Rolow . |
| 4,600,335 | 7/1986 | Truglio . |
| 4,624,600 | 11/1986 | Wagner et al. . |
| 4,627,763 | 12/1986 | Roemer et al. . |
| 4,630,395 | 12/1986 | Nasatka . |
| 4,647,246 | 3/1987 | Brink et al. . |
| 4,666,331 | 5/1987 | Riley . |
| 4,669,912 | 6/1987 | Truglio . |
| 4,705,426 | 11/1987 | Perea . |
| 4,711,608 | 12/1987 | Ghusn . |
| 4,715,742 | 12/1987 | Dickinson . |
| 4,752,152 | 6/1988 | Crisp et al. . |
| 4,759,655 | 7/1988 | Gorlov . |
| 4,762,439 | 8/1988 | Carlyle . |
| 4,775,261 | 10/1988 | Fladung . |
| 4,818,136 | 4/1989 | Nasatka et al. . |
| 4,818,137 | 4/1989 | Gorlov . |
| 4,822,207 | 4/1989 | Swahlan . |
| 4,824,282 | 4/1989 | Waldecker . |
| 4,826,349 | 5/1989 | Nasatka . |
| 4,828,424 | 5/1989 | Crisp, Sr. . |
| 4,850,737 | 7/1989 | Nasatka et al. . |
| 4,861,185 | 8/1989 | Eikelenboon . |
| 4,879,554 | 11/1989 | Diaz-Silveira . |
| 4,893,119 | 1/1990 | Nasatka . |
| 4,916,859 | 4/1990 | Butler . |
| 4,923,327 | 5/1990 | Gorlov . |
| 4,934,097 | 6/1990 | Quante . |
| 4,974,991 | 12/1990 | Mandavi . |
| 4,995,756 | 2/1991 | Kilgrow et al. . |

(List continued on next page.)

*Primary Examiner*—Michael Powell Buiz
*Attorney, Agent, or Firm*—Oblon, Spivak, McClelland, Maier, & Neustadt

[57] ABSTRACT

A tire deflator and method of deflating a tire of a moving vehicle includes at least one support mechanism and a spike secured to the at least one support mechanism such that upon the tire of the moving vehicle being penetrated by the spike, both the spike and support mechanism rotate with the tire so as to allow for rapid air depletion of the tire. The method includes the steps of securing the spike to the at least one support mechanism, positioning the support mechanism in a roadway and penetrating the tire with a spike such that the spike and support mechanism as an integral unit becomes secured to the tire and rotate with the tire after the tire is penetrated by the spike.

20 Claims, 4 Drawing Sheets

U.S. PATENT DOCUMENTS 4,998,843 3/1991 Mothe .
5,026,203 6/1991 Gorlov .
5,054,237 10/1991 Kapala et al. .
5,070,646 12/1991 Colombo .
5,099,579 3/1992 Chadwick .
5,123,774 6/1992 Dubiel .
5,192,158 3/1993 Bailey et al. .
5,228,237 7/1993 Nasatka .
5,248,215 9/1993 Fladung .

TIRE DEFLATOR AND METHOD OF DEFLATING A TIRE

BACKGROUND OF THE INVENTION

1. Field of the Invention

The present invention concerns a tire deflator and method of deflating a tire the purpose of which is to provide law enforcement and security personnel with a mechanism for disabling vehicles which fail to stop at check points. Disabling such vehicles precludes high-speed chases which are dangerous to both police officers and to the general public. The tire deflator can be used at permanent facilities, e.g. U.S. Customs inspection points, and at improvised check points such as police road blocks or other locations where access by non-authorized personnel can be selectively prohibited. Desired features of the present invention include the fact that the tire deflator is light in weight, is usable on an unmodified roadway, can be remotely deployable and retractable (in the permanent facilities application) and allows for rapid immobilization of an offending vehicle.

2. Discussion of the Background

Devices are known which can be utilized to immobilize automobiles under desired conditions. These devices, however, have drawbacks in that they are often very heavy and require modification of the roadway in use. Moreover, many of these devices are fixed in place and are neither remotely deployable or retractable, and thus do not allow for rapid immobilization of an offending vehicle when necessary. In addition, many known devices do not allow for rapid deflation of the tires of an offending vehicle such that the vehicle may proceed significant distances from the immobilization device before the tires of the vehicle are completely deflated.

SUMMARY OF THE INVENTION

An object of the invention is to immobilize automobiles by rapidly deflating their tires while avoiding the drawbacks of the known devices discussed above. Deflation is accomplished by hollow, hardened steel spikes penetrating, and being retained in, the tires. Tests indicate that deflation is very rapid when the spike is retained in the tire, but slower and variable if the spike is permitted to withdraw or become dislodged from the tire after penetration. While numerous known devices claim a similar capability, actual testing of the same has generated a proven system in accordance with the present invention with a number of desirable features.

The tire deflator of the present invention includes a linear array of hollow, sharpened spikes that can be placed across an entrance or roadway. Each individual spike is permanently detachably mounted on its own support block of metal, plastic or other desirable material which, in turn, is mounted on a continuous base plate that provides support for a plurality of spikes. Each spike is attachable to a passage in the support block and the combined spike and support block is detachable as an integral unit from the base plate after tire penetration so as to remain attached to the tire after penetration of the tire by the spike. Between the support blocks there may be disposed spacer or filler blocks for proper positioning of the spikes laterally across the roadway.

Testing has demonstrated that a large tipping moment exists when an automobile tire encounters an array of spikes, and that the spikes will ineffectively roll over unless supported by a rigid, strong substrate of dimensions suitable for countering this moment. The block attached to each spike in accordance with the present invention is dimensioned so as to maintain the spike in a vertical orientation while being overrun.

Tests in accordance with the present invention also demonstrate that separation of the spike from its supporting block after tire penetration may not reliably occur if the supporting block remains fixed to a stationary base plate even if the spike is loosely fitted into the support block. This is due to the torque on the spike within the fixed supporting block tending to retain the spike and lift the base plate as the tire rolls over the spike. For this reason, the present invention provides for a supporting block, along with its spike embedded in the tire, to detach from the base plate and rotate with the tire. The hollow spike extends completely through a passage in the supporting block, thereby providing an unobstructed airway for tire deflation.

Accordingly, the tire deflator of the present invention comprises a tire deflator for deflating a tire of a moving vehicle, which includes at least one support mechanism and a spike secured to the at least one support mechanism such that upon the tire of the moving vehicle being penetrated by the spike, both the spike and support mechanism rotate with the tire.

The method of deflating a tire of a moving vehicle in accordance with the present invention includes the steps of securing a spike to at least one support mechanism and penetrating the tire of the moving vehicle with the spike such that the spike and support mechanism become secured to the tire and rotate with the tire after the tire has been penetrated by the spike.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein like reference numbers designate the same or similar structure features, and wherein.

DESCRIPTION OF THE PREFERRED EMBODIMENT

Figure 1:
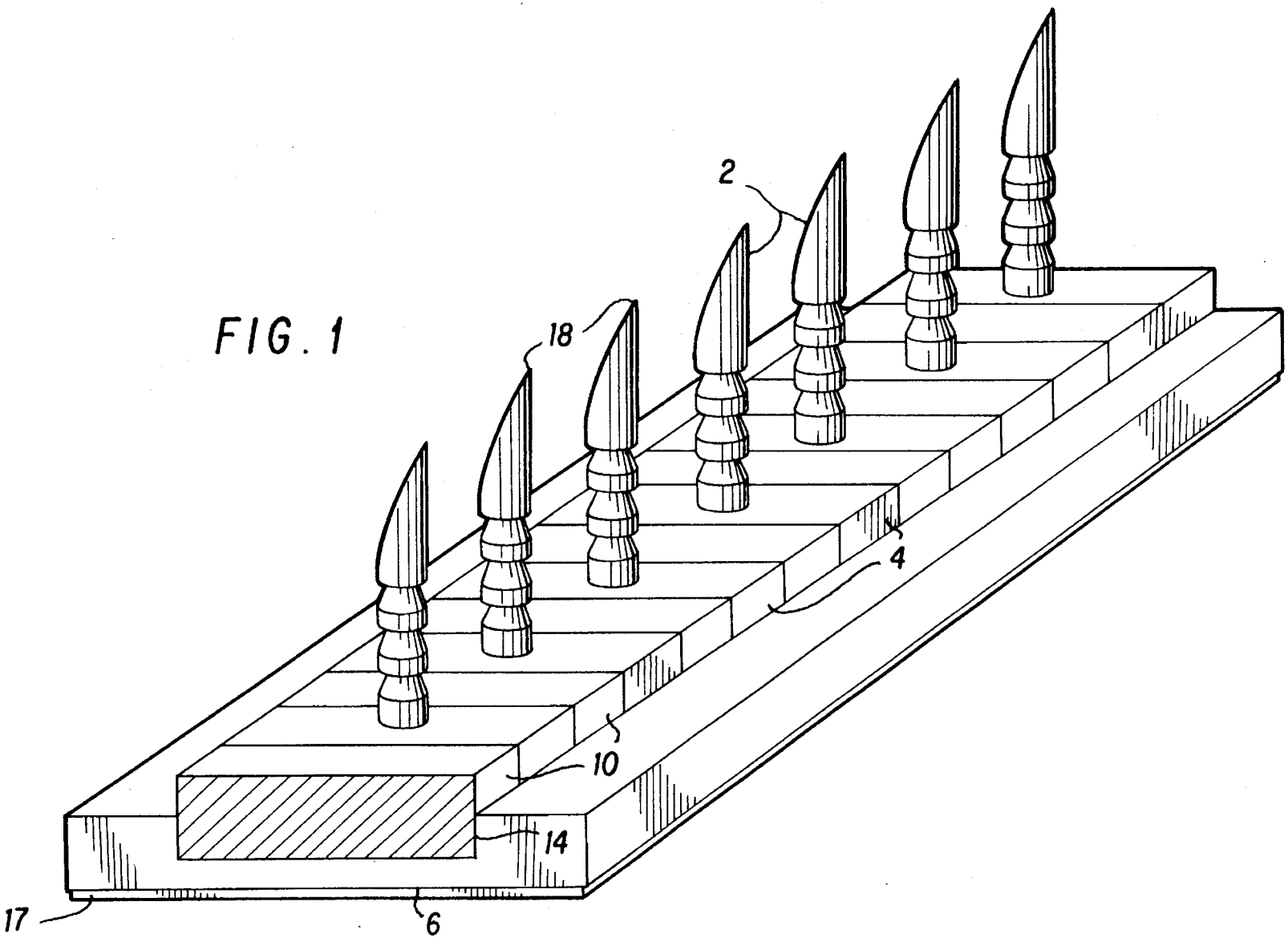
FIG. 1 is a perspective view showing the tire deflator in accordance with the present invention.
Figure 2:
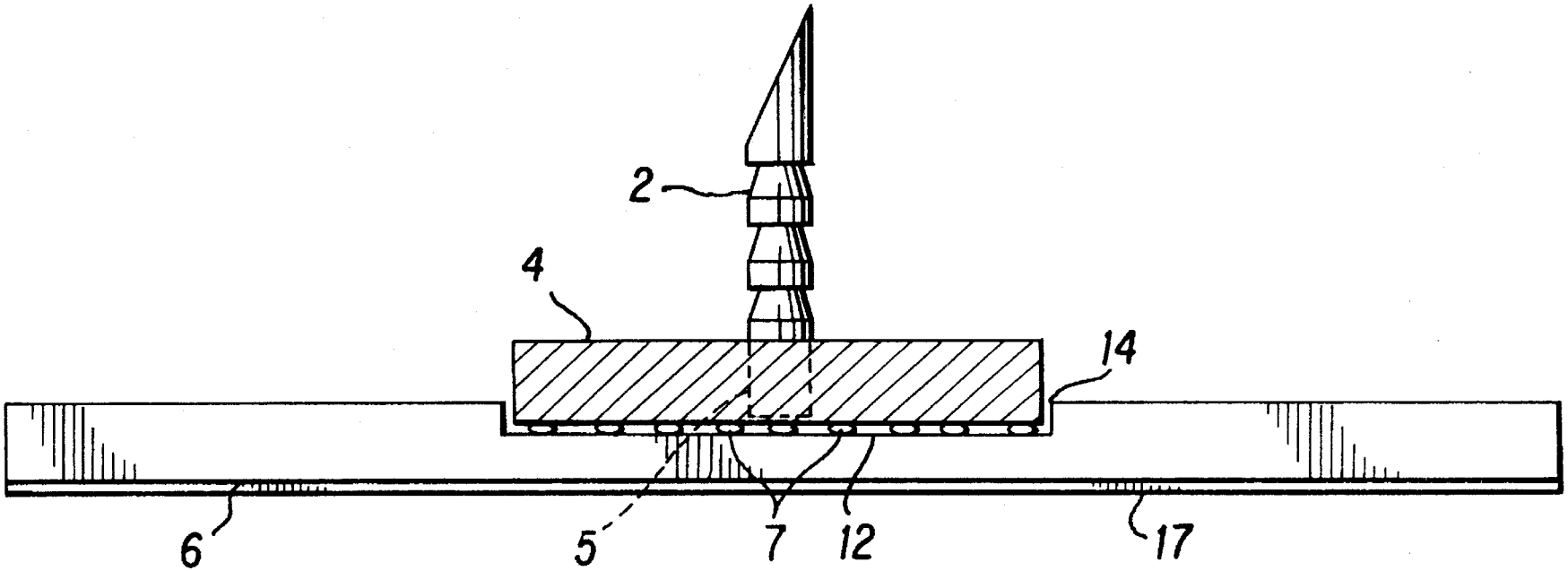
FIG. 2 is an end view of the tire deflator of FIG. 1.
Figure 3:
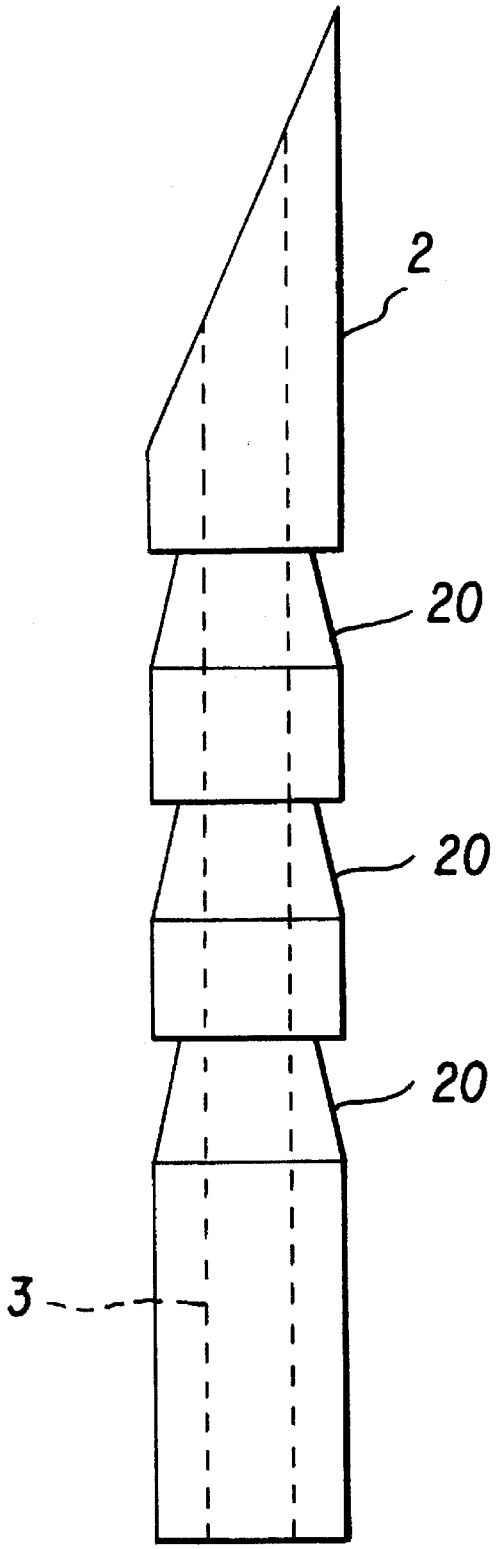
FIG. 3 is a side elevational view of the spike prior to being mounted in the support block and showing details of bevels which are cut into the spike.

FIGS. 1–4 show the first embodiment of the tire deflator 1 of present invention. This embodiment has been developed in view of the above-noted tests which have demonstrated that separation of the spike from its supporting block does not reliably occur after tire penetration if the support block remains fixed to the stationary base plate. For this reason, the present invention provides for a support block 4, along with a spike 2 embedded in the tire, to detach from the base plate and rotate with the tire. The hollow spike 2 extends completely through a passage 5 of the support block 4, thereby providing an unobstructed airway for tire deflation. A hollow passage 3 is provided in the spike as shown in FIG. 3.

The base plate 6 provides a stationary support platform for a multiplicity of individual spikes, 2,2 and support blocks 4,4. The base plate 6 has a groove or channel 12 provided in the upper surface thereof that accepts a corresponding bottom portion of the support blocks 4. The purpose of this arrangement is to restrain the support blocks 4 from sliding off the base plate 6 when impacted by a tire 8. The loose fit 14 between the channel in the base plate 6 and the support blocks exist: so as to permit easy release of the support block after the spike 2 punctures the tire 8.

Figure 4:
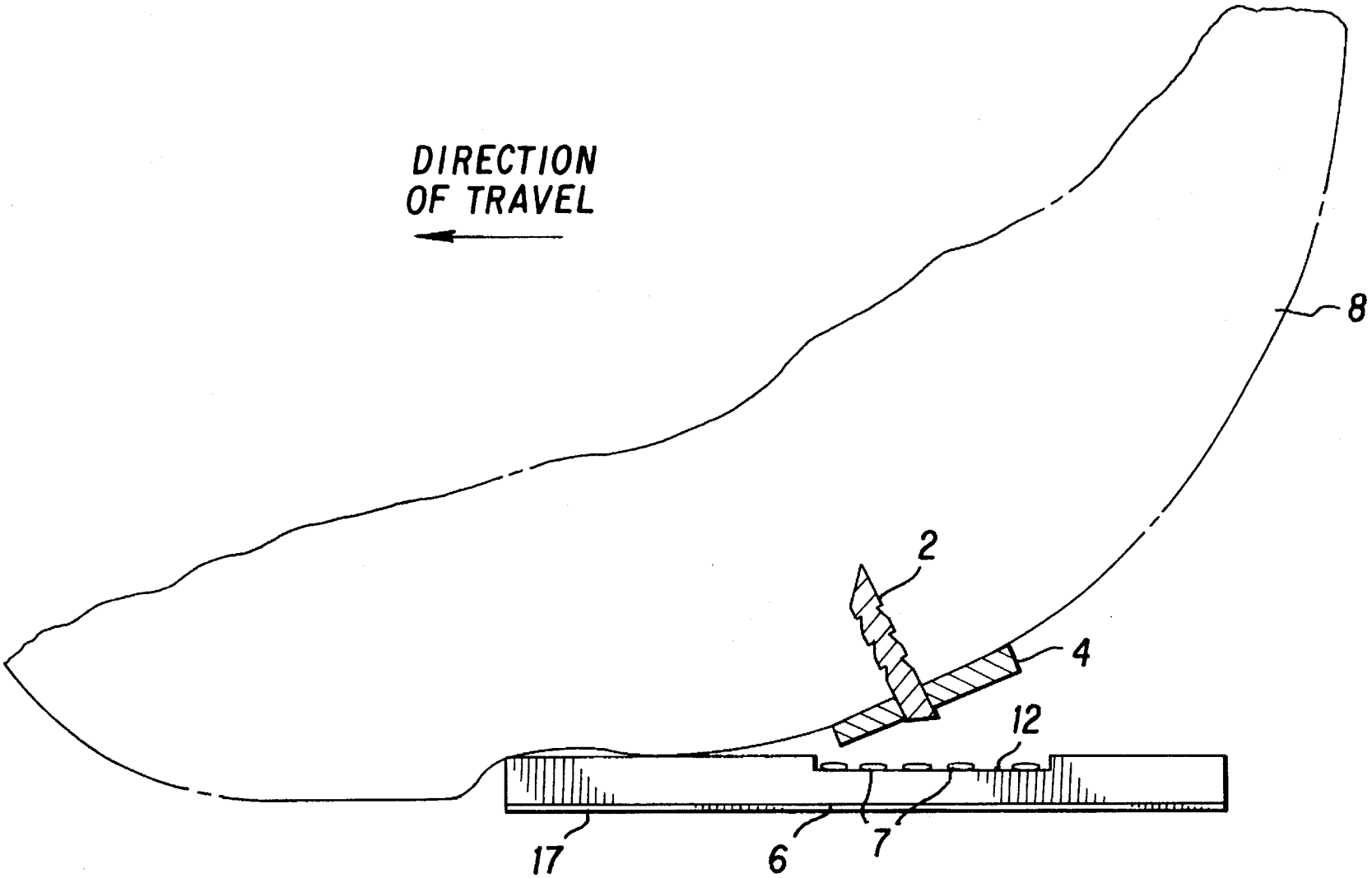
FIG. 4 shows the method of operation of the tire deflator upon the tire being punctured by the spike

The combined spike-support block units are retained in the base plate 6 by use of an adhesive 7 designed to break under the force of a tire impact. When the tire 8 rolls onto the spike in its corresponding support block, the tire is impaled by the spike. As shown in FIG. 4, upon continued rotation of the tire 8, the spike 2, with its attached support block 4, is unhindered in lifting away from the base plate 6 and the two, as a unit, rotate with the tire. The hollow impaled spike with the support block, the support block having the passage 5 formed therein, provides a large airway for rapid tire deflation. The underside of the base plate 6 is provided with a high-friction material/geometry 17, for preventing sliding on the pavement when struck by the tire. Spacers 10,10 can be placed on opposite sides of the support blocks 4,4 for providing predetermined spacing between adjacent spikes 2,2.

The spike 2 itself is fabricated from a suitably hard steel tubing sharpened to a sharp point 18 on an upper end thereof. External, circumferential bevels 20, for example, may be cut into the spike so as to act as barbs and retain the spike in the tire after penetration. The spike when installed in the support block, is permanently affixed to the support block by friction, welding, adhesives or other means.

Two types of deployment are anticipated for each of the embodiments shown, these being for a fixed site and for an improvised site.

Fixed sites include permanently established U.S. Customs and Border Patrol inspection sites, sensitive government facilities such as nuclear weapons storage sites, secured industrial and private property, etc. In these applications, it is desirable that the tire deflator be retractable (e.g. by linear or pivoting movement on a platform secured to a shoulder portion of the roadway) so as to allow passage of authorized vehicles, but be quickly deployable to stop an intruding vehicle. In many instances, no permanent modification of the roadway is permitted at these facilities and thus the tire deflator of the present invention is readily adaptable to these situations.

The preferred embodiment of the invention for a fixed-site deployment is a swing-out system wherein the deflator initially lies parallel to the flow of traffic, in or alongside the roadway, and swings across the roadway when it is desired to block traffic. Deployment and retraction would preferably be remotely commanded by a guard or appropriate sensor but could be done manually by a second guard under certain circumstances. In addition, a shield for preventing injury from an individual falling on the spikes may also be provided when the tire deflator is in the retracted position. An equally viable deployment system is a drop-down type where the deflator is retracted in a vertical position, and is lowered across the roadway when it is desired to deny access by vehicular traffic.

Improvised sites include all ad-hoc uses where a permanent guard force is not on location. Examples of this are police roadblocks, emergency traffic flow control and use by temporary guard contingents for security at corporate and private functions.

For improvised site applications, the tire deflator could be supplied, for example, in three feet long sections with multiple sections packaged in a single container. These relatively compact packages could be transportable in a police cruiser or four wheel drive vehicle, for example. They would be deployed by manually placing sections on the roadway or shoulder areas desired to be denied to traffic. These sections would be interconnectable and provided with removable shields to facilitate handling and prevent injury prior to deployment.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United Stated is:

1. A tire deflator for deflating a tire of a moving vehicle, which comprises:

at least one support mechanism;

a spike secured to said at least one support mechanism; and a base member upon which said at least one support mechanism is detachably mounted such that upon the tire of the moving vehicle being penetrated by the spike, both the spike and support mechanism rotate with the tire and said base member remains positioned in the roadway upon which the vehicle travels.

2. A tire deflator as claimed in claim 1, wherein said spike is hollow.

3. A tire deflator as claimed in claim 2, wherein said spike comprises a metal tube having a sharp point at an upper end portion thereof.

4. A tire deflator as claimed in claim 1, wherein said spike comprises a mechanism for securing said spike to said tire upon said tire being penetrated by said spike.

5. A tire deflator as claimed in claim 1, which comprises a securing mechanism securing said spike to said support mechanism.

6. A tire deflator for deflating a tire of a moving vehicle, which comprises:

at least one support mechanism;

a spike secured to said at least one support mechanism such that upon the tire of the moving vehicle being penetrated by the spike, both the spike and support mechanism rotate with the tire; and a base plate upon which said support mechanism is mounted such that said support mechanism is separable from said base plate upon said tire being penetrated by said spike.

7. A tire deflator as claimed in claim 6, which comprises a mechanism for detachably securing said support mechanism to said base plate.

8. A tire deflator as claimed in claim 7, wherein said mechanism detachably securing said support mechanism to said base plate comprises one of an adhesive and a frangible tab.

9. A tire deflator as claimed in claim 6, which comprises.

a contact surface member attached to a bottom portion of said base plate, said contact surface member preventing sliding of said base plate once said base plate is struck by the tire.

10. A tire deflator as claimed in claim 2, wherein said support mechanism has a hollow passage for unobstructed flow of air therethrough from said spike and said tire after said tire is penetrated by said spike.

11. A tire deflator as claimed in claim 6, wherein said at least one support mechanism comprises a plurality of support mechanisms and which comprises a spacer mechanism positioned between adjacent support mechanisms and providing a predetermined spacing between the spike and each of the support mechanisms.

12. A tire deflator as claimed in claim 6, wherein said base plate has a groove formed therein to which said support mechanism is fitted.

13. A tire deflator as claimed in claim 6, wherein said spike and said support mechanism comprise a detachable integral unit separated from said base upon said tire being penetrated by said spike.

14. A tire deflator for deflating a tire of a moving vehicle, which comprises:

at least one support mechanism;

a spike secured to said at least one support mechanism wherein said spike comprises a mechanism securing said spike to said tire upon said tire being penetrated by said spike;

a base member upon which said at least one support mechanism is detachably mounted; and a mechanism maintaining connection of said support mechanism to said spike upon rotation of said tire after said tire has been penetrated by said spike and passes air from said tire such that upon the tire of the moving vehicle being penetrated by the spike, both the spike and support mechanism rotate with the tire.

15. A tire deflator as claimed in claim 14, wherein said spike is hollow.

16. A method of deflating a tire of a vehicle, which comprises:

securing a spike to at least one support mechanism; and detachably mounting said at least one support mechanism on a base plate;

positioning said base plate with said at least one support mechanism in a roadway for the vehicle; and penetrating the tire of the vehicle with the spike such that the spike and support mechanism become secured to the tire and rotate with the tire after the tire is penetrated by the spike.

17. A method of deflating a tire as claimed in claim 16, wherein said spike comprises a hollow tubular spike and said support mechanism has a passage formed therein and wherein securing of the spike comprises securing the spike to the hollow passage of the support mechanism such that air in the tire flows freely through the spike and said passage in the support mechanism after penetrating of the tire with said spike.

18. A method of deflating a tire as claimed in claim 16, which comprises making the bottom portion of the base plate have a friction characteristic which prevents sliding of the base plate on the roadway upon penetration of the tire by said spike.

19. The method as claimed in claim 16, which comprises attaching to a bottom portion of said base plate a contact surface member having a greater friction characteristic than said base plate so as to prevent sliding of said base upon penetrating of the tire by said spike.

20. A method of deflating a tire as claimed in claim 16, which comprises forming a securing mechanism on said spike such that said securing mechanism secures said spike and support mechanism as an integral unit to the tire upon penetrating the tire with the spike.

* * * * *